US006731208B1

(12) United States Patent
Lee

(10) Patent No.: US 6,731,208 B1
(45) Date of Patent: May 4, 2004

(54) HOUSE INTERCOM SECURITY SYSTEM

(76) Inventor: Hsin Wu Lee, 4F., No. 21, An Ping Rd., Chung Ho City, Taipei Hsien (TW)

( * ) Notice: Subject to any disclaimer, the term of this patent is extended or adjusted under 35 U.S.C. 154(b) by 0 days.

(21) Appl. No.: 09/779,516

(22) Filed: Feb. 9, 2001

(51) Int. Cl.[7] ..... G08B 21/00

(52) U.S. Cl. ..... 340/540; 340/541; 340/286.11; 340/330; 379/40; 379/41; 379/51

(58) Field of Search ..... 340/545.1, 540, 340/541, 539, 286.01, 286.11, 330; 379/37, 39, 40, 44, 41, 45, 48, 51

(56) References Cited

U.S. PATENT DOCUMENTS 3,990,075 A * 11/1976 Schmitz et al. ..... 340/384.7
4,731,821 A * 3/1988 Jackson, III. ..... 379/102.6
5,802,467 A * 9/1998 Salazar et al. ..... 340/825.72
6,097,288 A * 8/2000 Koeppe, Jr. ..... 340/286.11

* cited by examiner

*Primary Examiner*—Nina Tong
(74) *Attorney, Agent, or Firm*—Bacon & Thomas

(57) ABSTRACT

A house intercom security system includes a main unit connected between the exchange line of a telecommunication office and a telephone set, an indoor intercom and an outdoor intercom respectively connected to the main unit, and an alarm connected to the main unit. The main unit is driven to dial a pre-set telephone number when a visitor presses on the outdoor intercom, as the host of the house in which the house intercom security system is installed is absent. The indoor intercom is driven to trigger the alarm and to dial a pre-set telephone number for help when the user presses on an alarm button of the indoor intercom.

4 Claims, 3 Drawing Sheets

HOUSE INTERCOM SECURITY SYSTEM

BACKGROUND OF THE INVENTION

The present invention relates to a security system for house and, more specifically, to a house intercom security system.

In an apartment house or residential building, every apartment or house is equipped with an indoor intercom for communication with an outdoor intercom. When the host is absent, the visitor cannot give a message to the host through the outdoor intercom.

SUMMARY OF THE INVENTION

The present invention has been accomplished to provide a house intercom security system, which eliminates the aforesaid problem. It is one object of the present invention to provide a house intercom security system, which automatically dials a pre-set telephone number to inform the host traveling outside upon the visit of a visitor, enabling the host to talk to the visitor by telephone. It is another object of the present invention to provide a house intercom security system, which automatically dials a pre-set telephone number to ask for help when the user presses the button of the indoor intercom. It is still another object of the present invention to provide a house intercom security system, which automatically dials a pre-set telephone number to inform a security office for help and turns on an alarm upon the intrusion of an intruder. According to the present invention, the house intercom security system is comprised of a main unit connected between the exchange line of a telecommunication office and the telephone set, an indoor intercom and an outdoor intercom respectively connected to the main unit for intercommunication, sensor means installed in the door and/or windows and connected to the main unit to detect intrusion of intruders, and an alarm connected to the main unit and driven by the main unit to give an alarm signal upon detection of the intrusion of an intruder by the sensor means or depressing of an alarm button of the indoor intercom by the user.

DETAILED DESCRIPTION OF THE PREFERRED EMBODIMENT

Figure 1:
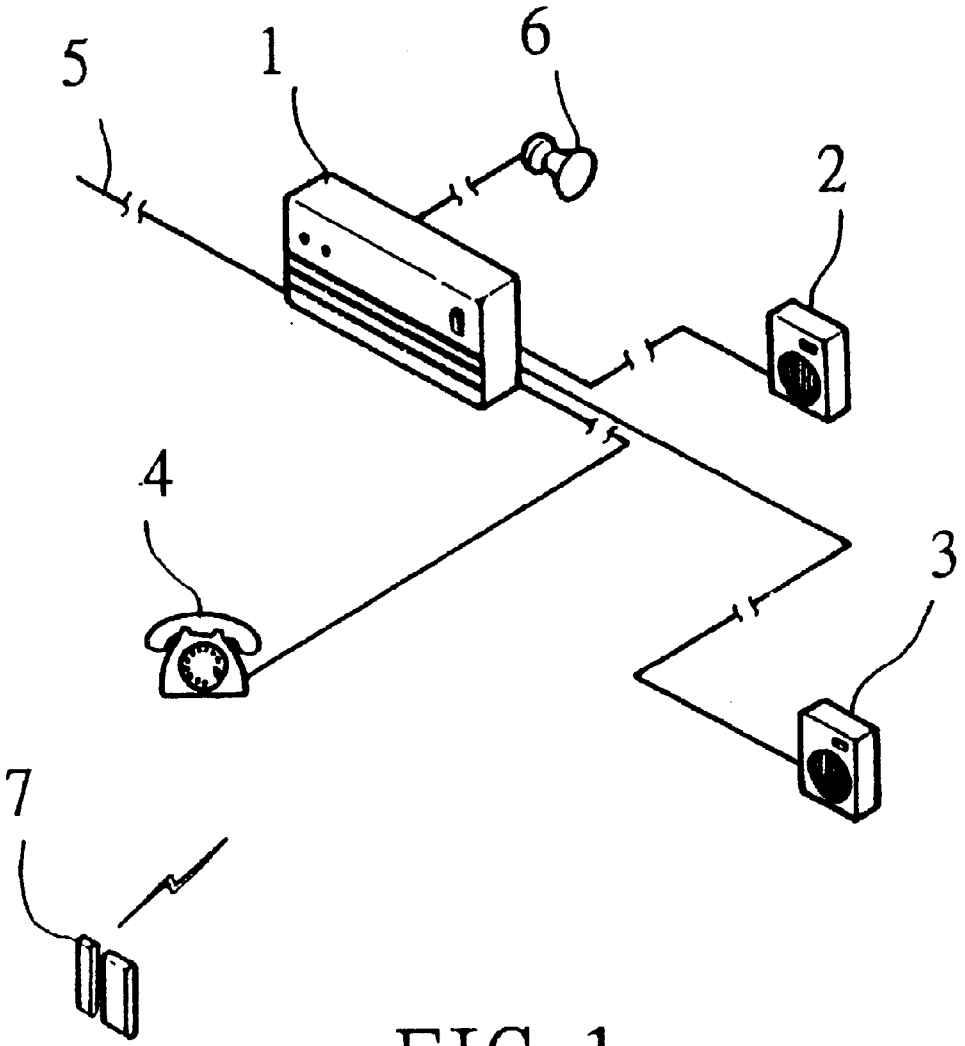
FIG. 1 illustrates the arrangement of a house intercom security system according to the present invention.

Referring to FIG. 1, the present invention comprises a main unit 1 connected to a telephone exchange line 5 from a telecommunication office, an indoor intercom 2, an outdoor intercom 3, and a telephone set 4. The indoor intercom 2, the outdoor intercom 3 and the telephone set 4 are respectively connected to the main unit 1. The main unit 1 enables the user to use the telephone set 4 to talk to the visitor at the outdoor intercom 3 or another member of the family at the indoor intercom 2. When the visitor talks to the outdoor intercom 3 as the host is absent, the main unit 1 immediately dials a pre-set phone number, enabling the host to talk to the visitor by phone. The host can press on an alarm button of the indoor intercom 2 to drive the main unit 1 to dial the telephone number of a security office or the like, and at the same time to turn on an alarm 6 being connected to the main unit 1.

The aforesaid main unit 1 can be used with sensor means 7 being installed in the door or window. When an intruder enters the house through the door or window, the vibration sensor means 7 is triggered to give a signal to the main unit 1, causing the main unit 1 to turn on the alarm 6, or to dial the telephone number of the security office.

Figure 2:
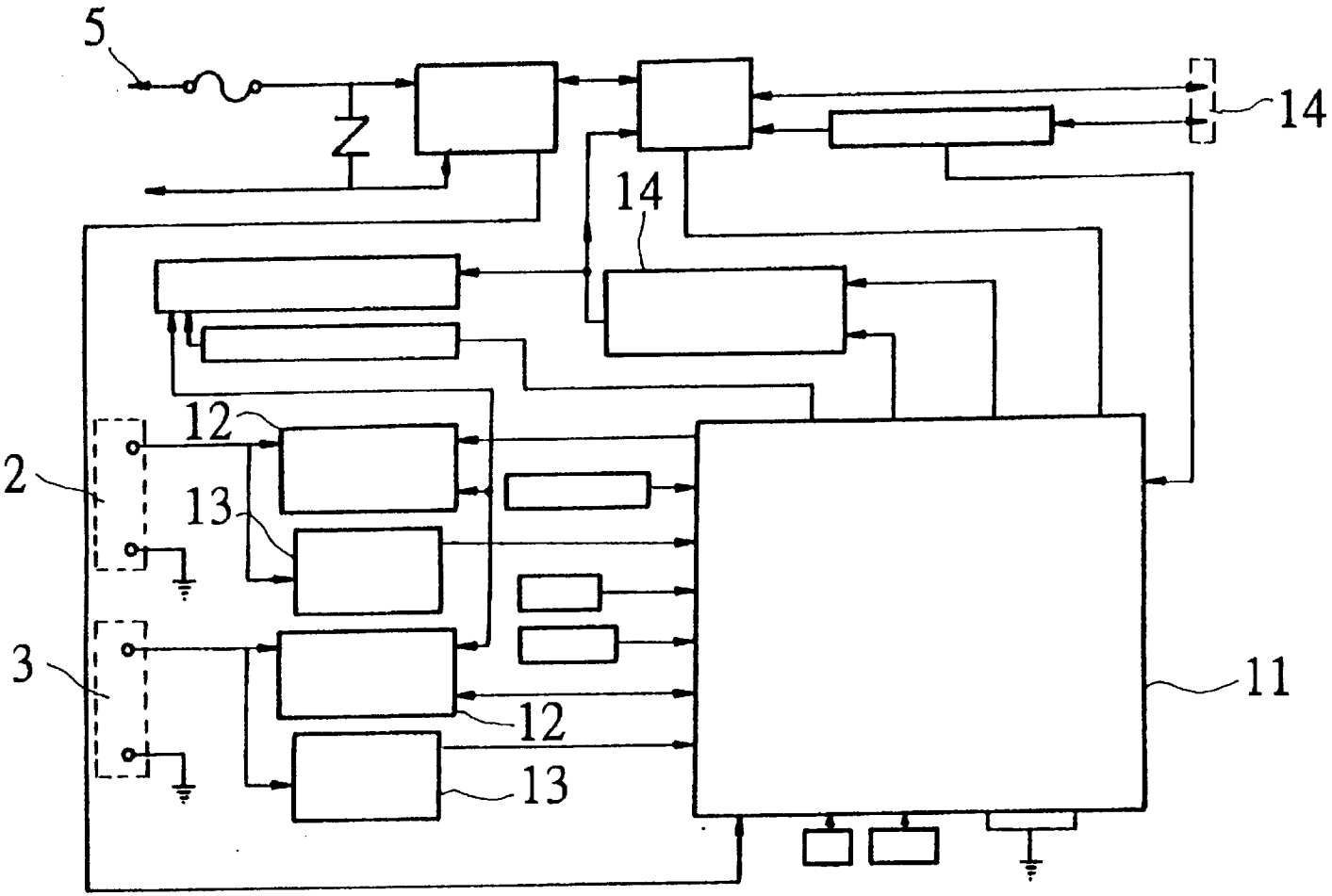
FIG. 2 is a circuit block diagram of the present invention (I).
Figure 3:
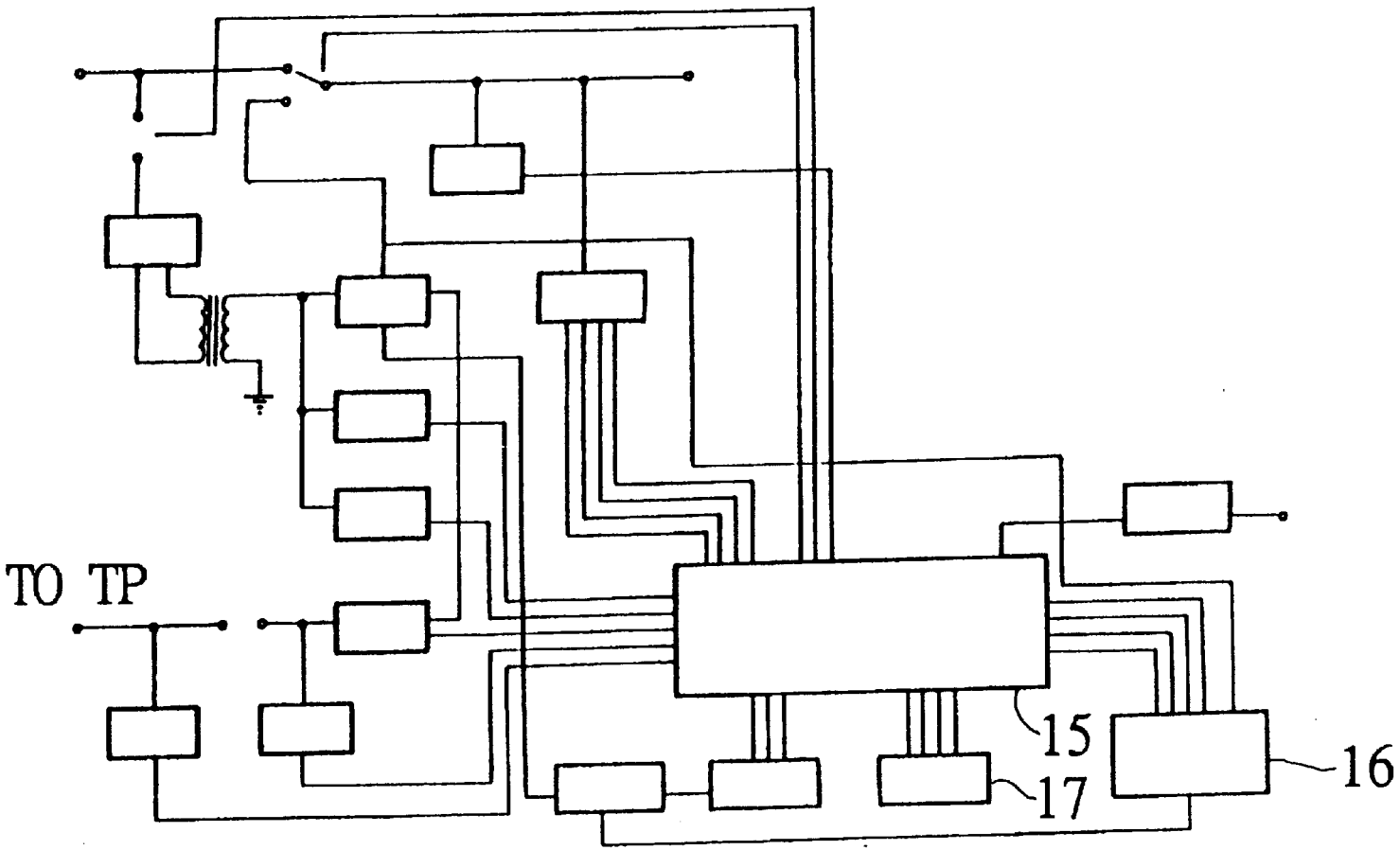
FIG. 3 is a circuit block diagram of the present invention (II).

Referring to FIG. 2, the main unit 1 comprises a MPU (microprocessor unit) 11 connected to the indoor intercom 2 and the outdoor intercom 3 through respective switches 12 and sensors 13. The output end of the MPU 11 is connected to the telephone set 4 through a ringing circuit 14. The telephone exchange line 5 is connected to the MPU 11 through a ringing circuit 14. The MPU 11 processes voice signal, enabling the telephone set 4 to be communicated with the indoor intercom 2 and the outdoor intercom Referring to FIG. 3, the main unit 1 further comprises a second MPU (microprocessor unit) 15, a voice processing unit 16 and a memory 17 and amplifier means respectively connected to the second MPU 15. The aforesaid alarm 6 is connected to the second MPU 15. By means of the voice processing unit 16 and the memory 17, the user can set a set of telephone numbers and record a piece of speech (for example, local address, calling) for help. When the user is in an emergency case, for example, suffering from disease, the user can directly operate the indoor intercom 2 to trigger the alarm 6, and to dial the pre-set telephone number of the security office for help. When installing the present house intercom security system, the existed intercom can be used and connected to the main unit 1 through an interface circuit.

It is to be understood that the drawings are designed for purposes of illustration only, and are not intended for use as a definition of the limits and scope of the invention disclosed.

What the invention claimed is:

1. A house intercom security system comprising:

a main unit, said main unit comprising a first microprocessor unit connected to the exchange line of a telecommunication office, and a second microprocessor unit;

an indoor intercom connected to the first microprocessor unit of said main unit;

an outdoor intercom connected to the first microprocessor unit of said main unit;

a telephone set connected to the first microprocessor unit of said main unit for intercommunication with said indoor intercom and said outdoor intercom;

memory means connected to said second microprocessor unit for storage of telephone numbers and voice data; and a voice processing connected to said second microprocessor and adapted to process voice from the user into voice data for storage in said memory means;

wherein said second microprocessor unit is driven to dial a pre-set telephone number when a visitor presses on said outdoor intercom as the host of the house in which the house intercom security system is installed is absent; said indoor intercom has button means, which when pressed, drives said second microprocessor unit to dial a pre-set telephone number for help.

2. The house intercom security system of claim 1 further comprising alarm means connected to said main unit and driven to output an alarm signal when the user pressed the button means of said indoor intercom to drive said second microprocessor unit to dial the pre-set telephone number for help.

3. The house intercom security system of claim 1 further comprising sensors respectively installed in the door and/or windows of the house in which the house intercom security system is installed, and connected to said main unit for driving said second microprocessor unit to dial the pre-set telephone number for help upon the intrusion of an intruder into the house.

4. The house intercom security system of claim 1 further comprising interface circuit means adapted to connect different intercoms to the first microprocessor unit of said main unit.

* * * * *